US007056881B2

(12) United States Patent
Howard et al.

(10) Patent No.: US 7,056,881 B2
(45) **Date of Patent: *Jun. 6, 2006**

(54) FABRIC CONDITIONING COMPOSITIONS

(75) Inventors: Jane Howard, Merseyside (GB); Mansur Sultan Mohammadi, Merseyside (GB); Kevin Anthony Ormandy, Merseyside (GB); John Stuart Parsons, Merseyside (GB)

(73) Assignee: Unilever Home & Personal Care USA a division of Conopco, Inc., Greenwich, CT (US)

( * ) Notice: Subject to any disclaimer, the term of this patent is extended or adjusted under 35 U.S.C. 154(b) by 265 days.

This patent is subject to a terminal disclaimer.

(21) Appl. No.: 10/363,591

(22) PCT Filed: Aug. 24, 2001

(86) PCT No.: PCT/EP01/09884

§ 371 (c)(1),
(2), (4) Date: Jun. 27, 2003

(87) PCT Pub. No.: WO02/20707

PCT Pub. Date: Mar. 14, 2002

(65) Prior Publication Data

US 2004/0048770 A1 Mar. 11, 2004

(30) Foreign Application Priority Data

Sep. 5, 2000 (GB) ..... 0021766.1

(51) Int. Cl.
*C11D 1/835* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 3,974,076 | A | 8/1976 | Wiersema et al. | |
| 5,066,414 | A | 11/1991 | Chang | |
| 5,531,910 | A | 7/1996 | Severns et al. | |
| 5,574,179 | A | 11/1996 | Wahl et al. | |
| 5,643,865 | A | 7/1997 | Mermelstein et al. | |
| 5,726,144 | A * | 3/1998 | Dewez et al. | 510/522 |
| 5,767,052 | A | 6/1998 | Shaw, Jr. et al. | |
| 5,856,287 | A * | 1/1999 | Motyka et al. | 510/342 |
| 5,964,939 | A | 10/1999 | Fox et al. | |
| 5,985,820 | A | 11/1999 | Khan-Lodi et al. | |
| 6,004,913 | A | 12/1999 | Iacobucci et al. | |
| 6,057,285 | A | 5/2000 | Pescador et al. | |
| 6,303,565 | B1 * | 10/2001 | Clarke et al. | 510/527 |
| 6,323,167 | B1 * | 11/2001 | Franklin et al. | 510/123 |

FOREIGN PATENT DOCUMENTS

| | | |
|---|---|---|
| EP | 0 309 052 | 3/1989 |
| EP | 730023 A2 * | 9/1996 |
| EP | 0 503 221 | 2/1998 |
| EP | 0 640 121 | 7/1999 |
| EP | 0 734 433 | 3/2000 |
| GB | 2 170 829 | 8/1986 |
| WO | 93/23510 | 11/1993 |
| WO | 94/20597 | 9/1994 |
| WO | 95/31524 | 11/1995 |
| WO | 96/21715 | 7/1996 |
| WO | 97/16516 | 5/1997 |
| WO | 97/34972 | 9/1997 |
| WO | 99/29823 | 6/1999 |
| WO | 99/50378 | 10/1999 |
| WO | 01/46360 | 6/2001 |
| WO | 01/96510 | 12/2001 |

OTHER PUBLICATIONS

UK Search Report No. GB 0021766.1 dated Feb. 7, 2001—1 p.

Int'l. Search Report No. PCT/EP 01/09884 dated Apr. 24, 2002—5 pp.

* cited by examiner

*Primary Examiner*—John R. Hardee
(74) *Attorney, Agent, or Firm*—Rimma Mitelman

(57) ABSTRACT

An aqueous fabric conditioning composition comprises (a) 7.5 to 60% by weight of a cationic fabric softening compound of a quaternary ammonium softening compound, the compound having one or more hydrocarbyl chains formed from parent fatty acyl compounds or fatty acids having an iodine value of between 0 and 20, (b) 0.01%–1.5% by weight of a nonionic surfactant viscosity modifier and (c) optionally up to 1.4% by weight of a fatty alcohol wherein the combination of (b) and (c) is no more than 1.5% by weight of the composition and the composition comprises particles having a mean diameter of from 0.3 to 7 microns, measured using a Malvern Mastersizer.

10 Claims, No Drawings

FABRIC CONDITIONING COMPOSITIONS

FIELD OF THE INVENTION

The present invention relates to a fabric conditioning composition, in particular a concentrated fabric conditioning composition.

BACKGROUND OF THE INVENTION

Fabric conditioning compositions are often used to deposit a fabric softening compound onto fabrics. These are usually rinse added fabric conditioning compositions. Typically, such compositions comprise a fabric softening agent dispersed in water. The fabric softening agent may be included at up to 7.5% by weight, in which case the compositions are considered dilute, or at levels from 7.5% to 60% by weight, in which case the compositions are considered concentrated.

It is obviously highly desirable for any fabric conditioning composition to provide excellent softening. It is known that better softening can be achieved using saturated (i.e. hardened) softening compounds instead of unsaturated or partially unsaturated softening compounds.

Hardened softening compounds are also believed to have less base odour than unsaturated softening compounds. Therefore, it is desirable that any fabric conditioning composition comprises hardened or substantially hardened softening compounds.

The inventors have now found that saturated quaternary ammonium fabric softening compounds based on triethanolamine (TEA) have lower melting temperatures than commercially available saturated softening compounds such as 1,2 bis[tallowoyloxy]-3-trimethylammonium propane chloride and N-N-di(tallowoyloxy ethyl) N,N-dimethyl ammonium chloride.

It is particularly desirable that the fabric conditioning composition should comprise a low melting point softening compound as this improves the ease of processing of the softening composition as well as the eventual formation of the aqueous dispersion. Thus, it is desirable to use saturated TEA-based fabric softening compounds in fabric conditioning compositions.

However, the inventors have found that concentrated compositions comprising saturated TEA-based fabric softening compounds suffer from viscosity instability (thickening) upon storage, especially at high temperature, e.g. above 30° C.

Instability can manifest itself as a thickening of the composition. This thickening can occur to a level at which the composition is no longer pourable or dispersible in use, and, can even lead to the formation of an irreversible gel. Such thickening is very undesirable because the composition can thereafter no longer be conveniently used, for example unpleasant residues can be left in the dispenser drawer of the washing machine and/or it is unattractive to the consumer.

However, high temperature storage stability is particularly desired by consumers.

It is known that fatty acids can reduce viscosity (by reducing the size of particles in the composition) as can inorganic and organic electrolytes. However, the inventors have found that none of these provide long term stability benefits for conditioning compositions comprising hardened TEA-based softening compounds.

Thus it is desirable to provide a fabric conditioning composition comprising hardened TEA-based fabric softening compound which overcomes the problem of high temperature instability.

WO 97/16516 discloses a softener composition comprising a cationic softener and a nonionic surfactant in a ratio of 1:2 to 4:1.

EP 640121 discloses a composition comprising a diester quat and 0.1 to 30% of a viscosity/dispersibility modifier. There is no mention of hardened softening compounds.

EP 734433 discloses mixtures of hardened and partially unsaturated ester quats. There is no mention of nonionic stabilising agents.

GB 2170829 discloses compositions comprising quaternary ammonium compounds and fatty alcohols in a ratio of 6:1 to 3:1. There is no mention of the iodine value of the quaternary ammonium compound.

WO 99/29823 discloses a process for making a softener composition comprising forming a melt of a softener and optional additives, dispersing this in water, cooling to below the Krafft temperature of the softener and adding dye and nonionic material. There is no suggestion that the nonionic material can be incorporated before the mixture cools. Furthermore, there is no reference to high-shear milling.

EP 503221 discloses a composition comprising a cationic softener, a linear fatty alcohol ethoxylate and a highly branched fatty alcohol. There is no mention of a hardened cationic softening compound.

EP 309052 discloses a composition comprising 11 to 25% of a quaternised ester-amine, 0.1 to 10% of a linear alkoxylated alcohol with 1 to 10 alkylene oxide groups and 60% or more of a liquid carrier.

OBJECTS OF THE INVENTION

The present invention seeks to provide a fabric conditioning composition comprising hardened TEA-based fabric softening compound which overcomes one or more of the problems, and provides one or more of the benefits, identified herein.

The present inventors have found that a reduced amount of a particular nonionic active agent in a fabric conditioning composition comprising hardened TEA-based fabric softening compound having a mean particle size below 7 microns acts as a viscosity stabiliser thereby providing a viscosity desired by consumers, even when included at very low levels (1.5% or less by weight in a fabric conditioning composition) and the small amount of the nonionic active agent does not destabilise the composition upon storage, even at high temperature.

SUMMARY OF THE INVENTION

According to the present invention there is provided an aqueous fabric conditioning composition comprising:

(a) 7.5 to 60% by weight of a cationic fabric softening compound of formula (I) as herein defined, the compound having one or more hydrocarbyl chains formed from parent fatty acyl/acid groups having an iodine value of from 0 to 20; and (b) 0.01%–1.5% by weight of a nonionic surfactant viscosity modifier; and (c) up to 1.4% by weight of a fatty alcohol wherein the combination of (b) and (c) is no more than 1.5% by weight of the total weight of the composition and the composition comprises particles having a mean diameter of from 0.3 to 7 microns, measured using a Malvern Mastersizer.

For the avoidance of doubt, the word "comprising" covers the normal meaning of the word "including" but is not limited to not "consisting of" or "composed of". In other words the listed steps, options and components are not exhaustive.

DETAILED DESCRIPTION OF THE INVENTION

The compositions of the invention provide excellent initial and long term storage stability.

For the purposes of the present invention, the phrase 'initial stability' is defined as the viscosity stability at room temperature of the composition (measured over the initial 24 hour period after formation of the composition).

For the purposes of the present invention, the phrase 'long term storage stability' is defined as the viscosity of the composition stored over a 4 week period at 37° C.

All viscosity measurement are made at $20s^{-1}$ using a Haake MV1 rotoviscometer at 25° C.

Cationic Fabric Softening Compound

The cationic fabric softening compound is a quaternary ammonium compound having at least one ester group and having one or more hydrocarbyl chains formed from a parent fatty acyl compound or fatty acid having a degree of unsaturation represented by an iodine value (I.V.) of from 0 to 20, more preferably 0 to 5, even more preferably 0 to 2, e.g. 0 to 1 or even less than 1.

Thus, the softening compound is referred to as substantially or fully saturated (hardened) because the fatty hydrocarbyl chains are substantially or even entirely composed of singly bonded carbon atoms.

It is considered advantageous to use a hardened (substantially or fully saturated) softening compound rather than an unsaturated or partially unsaturated compound since softening performance is generally better when using hardened softening compounds.

Also, hardened softening compounds are believed to have a lower odour than unsaturated softening compounds. This is especially noticeable when comparing quaternary ammonium compounds based on thiethanolamine.

Preferably the cationic softening compound has two $C_{12-28}$ alkyl or alkenyl groups connected to the nitrogen head group via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The cationic fabric softening compounds for use in the invention is based on TEA and is represented by formula (I):

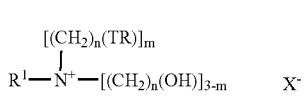

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

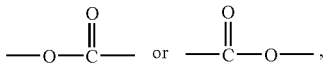

n is O or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Typically, TEA-based fabric softening compounds comprise a mixture of mono, di- and tri-ester forms of the compound where the di-ester form comprises no more than 70% by weight of the fabric softening compound, preferable no more than 60%, e.g. no more than 55%, or even no more than 45% of the fabric softening compound.

Especially preferred materials within this formula are di-alkenyl esters of triethanol ammonium methyl sulphate. A commercial example of a compound within this formula is Tetranyl AHT-1 (di-hardened oleic ester of triethanol ammonium methyl sulphate 80% active), ex Kao corporation.

It is also possible to include softening compounds with some degree of unsaturation in the long hydrocarbyl chains provided that the overall IV of the parent fatty acyl groups/acids of the softening compounds remains below 20, preferably below 5, more preferably below 2. Compounds with low levels of unsaturation include Tetranyl AT-1(di-oleic ester of triethanol ammonium methyl sulphate 90% active), L5/90 (palm ester of triethanol ammonium methyl sulphate 90% active (supplied by Kao corporation) and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation. If softening compounds with low levels of unsaturation are present in the composition, then the weight ratio of hardened compound to unsaturated compound is preferably greater than 4:1, more preferably greater than 6:1, e.g. 8:1 or more.

Hardened TEA-based softening compounds are chosen in preference to other quaternary ammonium ester compounds, such as N-di(tallowoyloxy ethyl) N,N-dimethyl ammonium chloride (referred to herein as "DEEDMAC") and 1,2 bis [tallowoyloxy]-3- trimethylammonium propane chloride (referred to herein as "HEQ") in view of their significantly lower melting points making compositions comprising these ingredients very much easier to formulate.

For example, HEQ with 10% isopropanol melts at about 100° C., whereas Tetranyl AHT-1 with 15% isopropanol melts at about 47° C.

The compositions comprise from 7.5 to 60% by weight of cationic softening compound (active ingredient) based on the total weight of the composition, more preferably 8 to 45% by weight, most preferably 8 to 30% by weight, or even 9 to 25% by weight, e.g. 11 to 22% by weight.

Iodine Value of the Parent Fatty Acyl Group or Acid

The iodine value of the parent fatty acyl compound or acid from which the cationic softening compound is formed is from 0 to 20, preferably from 0 to 5, more preferably from 0 to 2.

In the context of the present invention, iodine value of the parent fatty acyl compound or acid from which the cationic surfactant is formed, is defined as the number of grams of iodine which react with 100 grams of the fatty acyl compound or acid.

One method for calculating the iodine value of a parent fatty acyl compound/fatty acid from which the cationic softening compound is formed comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated. Other methods for calculating I.V. will be apparent to those skilled in the art.

Nonionic Surfactant Viscosity Stabiliser

The compositions comprise one or more nonionic surfactant viscosity stabilising agents.

Especially preferred nonionic surfactant viscosity stabilising agents for use in the compositions of the invention are alkoxylated nonionic fatty alcohols, such as fatty alcohols comprising $C_{10}$–$C_{22}$ alkyl/alkenyl chains alkoxylated with 3 to 30, more preferably 4 to 27, most preferably 6 to 25, e.g. 11 to 20 moles of alkoxy moieties. The fatty alcohols may be alkoxylated with ethylene oxide, propylene oxide or ethylene oxide/propylene oxide mixtures. Ethoxylated compounds are especially preferred.

The nonionic surfactant viscosity stabilising agent is present in the composition in an amount from 0.01% to 1.5% by weight, more preferably 0.2 to 1.4%, most preferably 0.4 to 1.2% by weight, based on the total weight of the composition.

Fatty Alcohol

Optionally and advantageously, one or more un-alkoxylated fatty alcohols are present in the composition.

Preferred fatty alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 1.4% by weight, more preferably from 0.005 to 1.2% by weight, most preferably from 0.01 to 0.8% by weight, based on the total weight of the composition.

The combined level of nonionic surfactant viscosity stabilising agent and fatty alcohol in the compositions of the invention does not exceed 1.5% by weight based on the total weight of the composition.

The weight ratio of the cationic softening material to the combined weight of the nonionic surfactant viscosity stabilising agent and optional fatty alcohol is preferably 5:1 to 50:1, more preferably 5:1 to 20:1, most preferably 5:1 to 15:1.

Water

The compositions of the invention are aqueous based.

Typically, the level of water present is from 0.5–92.49% by weight, more preferably 50–92% by weight, even more preferably 60–91% by weight, most preferably 70–90% by weight, based on the total weight of the composition.

Oils

The compositions of the present invention may comprise at least one oil.

The oil may be a mineral oil, a silicone oil, an ester oil and/or natural oils such as vegetable oils.

The ester oils are preferably hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

It is preferred that the viscosity of the ester oil is from 2 to 400 mPa·s at a temperature of 25° C. at 106 $s^{-1}$, measured using a Haake rotoviscometer MV1, and that the density of the mineral oil is from 0.8 to 0.9 $g \cdot cm^{-3}$ at 25° C. Suitable mineral oils include branched or straight chain hydrocarbons having 6 to 35, more preferably 7 to 20, most preferably 7 to 14 carbon atoms in the hydrocarbon chain, although if no low molecular weight alcohol is present in the composition, then the hydrocarbon chain length of the oil will preferably be in the range 6 to 12 carbon atoms.

Preferred mineral oils include the Marcol technical range of oils (ex Esso) although particularly preferred is the Sirius range (ex Silkolene) or Semtol (ex. Witco Corp.).

Suitable silicone oils are described in our co-pending application PCT/EP00/04223 (published as WO-A1-00/71806).

One or more oils of any of the above mentioned types may be used.

The oil may be present in an amount from 0.1 to 70% by weight, more preferably 0.2 to 20%, by weight most preferably 0.3 to 12%, e.g. 0.4 to 10% by weight based on the total weight of the composition.

The oil may be present as a component added into the composition separately from any other ingredient, or it may be present in other components of the composition, e.g. perfumes.

Solvent

In addition to any fatty alcohol which may be present in the compositions, the compositions may comprise one or more solvents.

The solvent may consist of a low molecular weight alcohol, such as a low molecular weight monohydric alcohol.

The presence of a lower molecular weight alcohol may also help to improve physical stability of the composition upon storage by lowering the viscosity to a more desired level.

Examples of suitable low molecular weight alcohols include ethanol, isopropanol, n-propanol, t-butyl alcohol, hexanol, heptanol, octanol, and the like.

It is especially preferred that the chain length of the hydrocarbon in the monohydric alcohol is 2 to 10, more preferably 3 to 9, most preferably 4 to 8 carbon atoms.

The alcohol may be branched or linear.

The solvent may be added to the composition either by being present as a component in the raw material comprising the cationic surfactant or it may be added separately.

The solvent is preferably present in an amount from 0.05% to 40% by weight, more preferably from 0.1% to 25% by weight, most preferably from 0.15% to 16% by weight e.g. 0.2% to 5% by weight, based on the total weight of the composition.

Mixtures of solvents may be used if desired.

Dispersion Aids

The compositions may comprise dispersion aids. Typical dispersion aids include mono-long chain alkyl cationic quaternary ammonium compounds and mono-long chain alkyl amine oxides.

Preferably the concentration of the dispersion aid is from 0.05–30% by weight, more preferably from 0.3–20% by weight, most preferably from 1–15% by weight, based on the total weight of the composition.

Anti-Oxidation/Reduction Stabilisers

The compositions of the invention may, optionally, comprise one or more additional compounds which stabilise against oxidation and/or reduction.

If the stabilisers are present as anti-oxidants, they may be added at a level of from 0.005 to 2% by weight based on the total weight of the composition, more preferably from 0.01 to 0.2% by weight, most preferably from 0.035% to 0.1% by weight.

If present as an anti-reduction agent, then the stabiliser is preferably used in an amount from 0.001% to 0.2% by weight based on the total weight of the composition.

Co-active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty amines and fatty N-oxides.

Perfumes

The compositions of the invention may also comprise one or more perfumes.

When present, the perfume is used in a concentration of preferably from 0.01–15% by weight, more preferably from 0.05–10% by weight, most preferably from 0.1–5% by weight, e.g. 0.15 to 4.5% by weight based on the total weight of the composition.

The perfume is preferably hydrophobic and has a ClogP value of 2.5 or more, more preferably 3 or more. For a discussion of ClogP and the method of its calculation, see WO 96/12785, of which the calculation method is incorporated by reference.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids, skin care agents as disclosed in EP 0789070 and dyes.

Fatty Acids

The composition is preferably substantially free of free fatty acid compounds since, when present in the TEA-based fabric conditioning compositions of the invention, they cause a significant adverse effect on high temperature (30° C. or more) long term stability of the composition.

The phrase "free fatty acids" means fatty acids which are added separately into the composition.

If free fatty acids are included, they are present at a very low level, e.g. 0.8% by weight or less, based on the total weight of the composition, more preferably 0.4% by weight or less, most preferably 0.3% by weight or less, e.g. 0.1% by weight or less.

If free fatty acids are included at higher levels, e.g. 1% by weight or more, the concentrated fabric conditioning compositions of the invention are prone to irretrievable thickening on long term storage at 37° C.

The inventors have also found that if fatty acids are present at a level of 1% by weight or more, based on the total weight of the composition, the softness performance of the composition is significantly reduced.

Particle Size

The mean diameter of particles in the fabric conditioning compositions of the invention is from 0.3 to 7 microns, more preferably 0.4 to 5 microns, most preferably 0.5 to 4 microns, measured at 106 $s^{-1}$ using a Malvern Mastersizer. The mean diameter is measured using volume average particle size D[4,3], in Malvern Terminology.

Outside of these ranges, the viscosity stability of the composition is significantly reduced.

Viscosity of the Product

The compositions preferably have an initial viscosity as herein defined of from 10 to 250 mPa·S, preferably 15 to 200 mPa·S, most preferably 20 to 180 mPa·S at a shear rate at 20 $s^{-1}$ at 25° C., and a long term viscosity as herein defined of from 10 to 250 mPa·S, preferably 15 to 200 mPa·S, most preferably 20 to 180 mPa·S at a shear rate at 20 $s^{-1}$ at 25° C. All measurements are made using a Haake MV1 rotoviscometer.

In its undiluted state at ambient temperature the product is in the form of an aqueous dispersion. Preferably the product is an aqueous dispersion of lamellar particles.

The composition is preferably used in the rinse cycle of a home textile laundering operation, where, it may be added directly to the washing machine, e.g. through a dispenser drawer. It can be diluted prior to use or can be added in an undiluted state. The compositions may also be used in a domestic hand-washing laundry operation.

Composition pH

When the composition is dispersed in water, the solution preferably has a pH of from 1.5 to 5.

Processing

The compositions of the invention are prepared according to any suitable method. Preferably, the mixture is subjected to high shear below the phase transition temperature of the softening compound for a length of time sufficient to achieve a viscosity of from 10 to 250 mPa·S at a shear rate of 20 $s^{-1}$ measured using a Haake Rotoviscometer MV1 at 25° C. High shear can be achieved by using static or dynamic mills preferably, but not exclusively, in a side-loop. Examples of dynamic milling devices include Janke-Kunkel or Silverson high-shear mills. Examples of static milling devices include needle valves and orifice plates. Other methods of achieving high shear will be apparent to those skilled in the art.

In the context of the present invention, high shear is defined as shear applied at an angular velocity (rpm) of from 3,000 to 10,000 where the number of batch volumes passing through a mill at the temperature below the phase transition temperature is from 0.5 to 4 batch volumes.

It will be apparent to those skilled in the art that at lower angular velocities, higher batch volumes will be required and at higher angular velocities, lower batch volumes will be required.

Phase Transition Temperature

Fabric conditioning compositions which comprise an aqueous dispersion of water insoluble cationic fabric softening compounds exist at ambient temperature as a phase which is a dispersion of lamellar droplets where the chains of the cationic softener exist in a solid or crystalline state (Lβ lamellar phase). As the temperature is raised the dispersed phase undergoes a transition to the Lβ lamellar phase where the chains of the cationic softener (with or without co-actives) will exist in a more fluid or liquid state. The temperature at which this transition occurs is referred to as the "phase transition temperature". The high shear is preferably applied at a temperature below this phase transition temperature. However, shear may, in addition, be carried out at higher temperatures.

For saturated TEA-based fabric softening compounds, the phase transition temperature is from 30 to about 65° C., and will be apparent to the person skilled in that.

If the softening material has more than one phase transition temperature, then the high shear must be carried out below the lowest phase transition temperature although it may in addition be carried out above this temperature.

The level and duration of shear can be used to control the viscosity of the final product.

EXAMPLES

The invention will now be illustrated by the following non-limiting examples. Further modification within the scope of the present invention will be apparent to the person skilled in the art.

Examples of the invention are denoted by a number whilst comparative examples are denoted by a letter.

Unless otherwise stated, all values are in percentage by weight based on the total weight of the composition.

Compositions 1 to 8 and A to D were prepared according to method 1 below.

Method 1

A cationic softening material, a nonionic surfactant viscosity stabiliser and, optionally, a fatty alcohol are mixed under heating and stirring to form a melted premix. In a separate vessel, water, and optionally antifoam and preservative, are heated under stirring. The melted premix is added slowly to the contents of the vessel, preferably with stirring until homogeneous. The resulting mixture is gently cooled to just above ambient temperature. Stirring is continued throughout. Additional optional ingredients, such as dye and perfume, may then be added. During the process, the material is subjected to high shear, as defined above, at a temperature below the phase transition temperature of the cationic softening material until such a time that the acceptable viscosity is reached.

The compositions formed according to this method comprise particles having a mean diameter of from 0.3 to 7 microns (measurements carried out at 106 $s^{-1}$ using a Malvern Masterisizer based on D[4,3].

The compositions are given in table 1, below.

TABLE 1

| Example | A | B | 1 | 2 | 3 | 4 | 5 | 6 | 7 | 8 | C | D |
|---|---|---|---|---|---|---|---|---|---|---|---|---|
| Cationic surfactant[a] | 12.5 | 12.5 | 13 | 12.5 | 12.5 | 12.5 | 12.5 | 12 | 12 | 12 | 12 | 12 |
| Nonionic viscosity stabiliser[b] | 1.8 | 2 | 0.75 | 0.75 | 0.75 | 0.75 | 0.6 | 0.75 | 0.75 | 0.75 | 1.6 | 1.8 |
| Fatty alcohol[c] | — | — | 0.75 | 0.5 | 0.6 | 0.75 | 0.6 | 0.5 | 0.6 | 0.75 | — | — |
| Preservative | ← Minor → | | | | | | | | | | | |
| Dye | | | | | | | | | | | | |
| Antifoam | | | | | | | | | | | | |
| Perfume | ← 0.95 → | | | | | | | | | | | |
| Water | ← To 100 → | | | | | | | | | | | |

[a]Tetranyl AHT1 (ex Kao). A hardened quaternary ammonium ester-linked material based on triethanolamine and having an IV of less than 1.
[b]Genapol C200. Coco-20 EO (ex Clariant)
[c]Hydrenol S3. Tallow alcohol (ex Sidobre Sinnova)
The results are given in table 2.

TABLE 2

| Storage time | Shear rate | Example | | | | | | | | | | | |
|---|---|---|---|---|---|---|---|---|---|---|---|---|---|
| (days/weeks) | ($s^{-1}$) | A | B | 1 | 2 | 3 | 4 | 5 | 6 | 7 | 8 | C | D |
| 0 days at 25° C. | 20 | 92 | 128 | 169 | 103 | 148 | 145 | 111 | 123 | 118 | 107 | 129 | 112 |
| | 106 | 43 | 52 | 86 | 54 | 69 | 63 | 54 | 68 | 60 | 53 | 61 | 53 |
| 1 day at 25° C. | 20 | 91 | — | 133 | 86 | 102 | 90 | 76 | 90 | 87 | 74 | 98 | 122 |
| | 106 | 40 | — | 67 | 39 | 45 | 42 | 36 | 48 | 42 | 39 | 49 | 54 |
| 4 weeks at 37° C. | 20 | 421 | 445 | 210 | 112 | 127 | 116 | 103 | 124 | 115 | 110 | 289 | 435 |
| | 106 | 155 | 174 | 105 | 60 | 63 | 52 | 56 | 59 | 51 | 52 | 115 | 147 |
| 6 weeks at 37° C. | 20 | — | — | — | 77 | 89 | — | — | — | — | — | — | — |
| | 106 | — | — | — | 45 | 42 | — | — | — | — | — | — | — |

The viscosity measurements were taken using a Haake Rotoviscometer (MV1) at the shear rates and indicated and at 25° C.

Comparison of the viscosity stability results for examples A to D with examples 1 to 8 demonstrates that there is a significant improvement in the stability of the compositions on storage (especially high temperature stability upon storage) when the total amount of the nonionic viscosity stabiliser and fatty alcohol in the compositions is restricted to 1.5% by weight or less.

The invention has been described by way of example only. Further modifications within the scope of the invention will be apparent to the person skilled in the art.

The invention claimed is:

1. An aqueous fabric conditioning composition comprising:

(a) 7.5 to 60% by weight of a cationic fabric softening compound of formula (I), the compound having one or more hydrocarbyl chains formed from parent fatty acyl compounds or fatty acids having an iodine value of between 0 and 20:

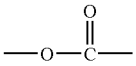

wherein each R is independently selected from a $C_{5-35}$ alkyl or alkenyl group, $R_1$ represents a $C_{1-4}$ alkyl, $C_{2-4}$ alkenyl or a $C_{1-4}$ hydroxyalkyl group, T is 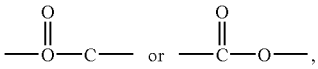

n is O or a number selected from 1 to 4, m is 1, 2 or 3 and denotes the number of moieties to which it relates that pend directly from the N atom, and $X^-$ is an anionic group;

(b) 0.01%–1.5% by weight of a nonionic surfactant viscosity modifier; and (c) about 0.01% to about 1.4% by weight of an unalkoxylated fatty alcohol having a hydrocarbyl chain length of about 15 to about 22 carbon atoms;

wherein the combination of (b) and (c) is no more than 1.5% by weight of the total weight of the composition; and wherein the composition comprises particles having a mean diameter of from 0.3 to 7 microns measured using a Malvern Mastersizer.

2. A composition as claimed in claim 1 wherein iodine value of the parent fatty acid or acyl compound of formula (I) is from 0 to 5.

3. A composition as claimed in claim 1 wherein the nonionic surfactant comprises a $C_{10-22}$ fatty alcohol ethoxylated with 6 to 25 moles of ethylene oxide.

4. A composition as claimed in claim 1 wherein the nonionic surfactant is present in an amount from 0.4 to 1.2% by weight.

5. A composition as claimed in claim 1 wherein the weight ratio of the softening compound (a) to the combined weight of compounds (b) and (c) is 5:1 to 50:1.

6. A composition as claimed in claim 1 further comprising an oil.

7. A composition as claimed in claim 1 further comprising a low molecular weight alcohol.

8. A composition as claimed in claim 7 wherein the low molecular weight alcohol is present in an amount of from 0.15% to 16% by weight based on the total weight of the composition.

9. A composition as claimed in claim 1 wherein the diester component of the softening compound (a) comprises no more than 55% by weight of the fabric softening material.

10. A composition as claimed in claim 1 wherein the softening compound (a) is present in an amount from 9 to 25% by weight based on the total weight of the composition.

* * * * *

UNITED STATES PATENT AND TRADEMARK OFFICE

CERTIFICATE OF CORRECTION

PATENT NO. : 7,056,881 B2
APPLICATION NO. : 10/363591
DATED : June 6, 2006
INVENTOR(S) : Howard et al.

It is certified that error appears in the above-identified patent and that said Letters Patent is hereby corrected as shown below:

Column 11
Lines 15-20, please replace formula

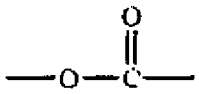

with formula

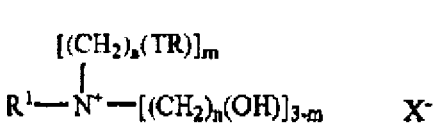

(I)

Signed and Sealed this

Twelfth Day of January, 2010

David J. Kappos

David J. Kappos
*Director of the United States Patent and Trademark Office*